US008985618B2

(12) United States Patent
Perk

(10) Patent No.: US 8,985,618 B2
(45) Date of Patent: Mar. 24, 2015

(54) WHEELCHAIR COMPRISING A HEIGHT-ADJUSTABLE AND INCLINE-ADJUSTABLE SEAT

(71) Applicant: Otto Bock Mobility Solutions GmbH, Koenigsee (DE)

(72) Inventor: Heinrich Perk, Aglasterhausen (DE)

(73) Assignee: Otto Bock Mobility Solutions GmbH, Koenigsee (DE)

( * ) Notice: Subject to any disclaimer, the term of this patent is extended or adjusted under 35 U.S.C. 154(b) by 0 days.

(21) Appl. No.: 14/345,881

(22) PCT Filed: Sep. 17, 2012

(86) PCT No.: PCT/EP2012/003882

§ 371 (c)(1),
(2) Date: Mar. 19, 2014

(87) PCT Pub. No.: WO2013/041201

PCT Pub. Date: Mar. 28, 2013

(65) Prior Publication Data

US 2014/0327231 A1 Nov. 6, 2014

(30) Foreign Application Priority Data

Sep. 19, 2011 (DE) ..... 10 2011 117 671

(51) Int. Cl.
*A61G 5/00* (2006.01)
*A61G 5/08* (2006.01)

(52) U.S. Cl.
CPC ..... *A61G 5/08* (2013.01); *A61G 2005/0808* (2013.01); *Y10S 297/04* (2013.01)
USPC ..... 280/647; 280/47.41; 280/250.1; 297/313; 297/DIG. 4

(58) Field of Classification Search
USPC ..... 280/638, 642, 647, 648, 649, 650, 657, 280/658, 47.34, 47.38, 250.1, 47.41; 297/313, 326, 327, 328, DIG. 4
See application file for complete search history.

(56) References Cited

U.S. PATENT DOCUMENTS 2,986,200 A 5/1961 Nobile
3,198,575 A * 8/1965 Hawkins ..... 297/328

(Continued)

FOREIGN PATENT DOCUMENTS

DE 8908374 U1 9/1989
DE 102004045388 A1 4/2006

(Continued)

OTHER PUBLICATIONS

PCT International Search Report for PCT International Patent Application No. PCT/EP2012/003882, mailed Jan. 23, 2013.

*Primary Examiner* — John Walters
(74) *Attorney, Agent, or Firm* — Holland & Hart

(57) ABSTRACT

The invention relates to a wheelchair which comprises: a underframe (1) to which front steerable wheels (6) and rear drive wheels (7) are fixed at a distance from one another; a sealing frame (3) which is height-adjustably fixed to said underframe (1), mounted so as to be able to pivot about a rotational axis (D), and which can be incline-adjusted with regard to the horizontal line (H) as well as height-adjusted; and a backrest frame which is connected to the seating frame (3) consisting of two longitudinal tubes (9) lying opposite each other and at least one transverse tube (10) which interconnects these longitudinal tubes (9); a) said seating frame (3) being connected to the underframe (1) by means of at least two telescopic tubes (2) each formed from one lower (2*b*) and one upper (2*a*) tube; b) the lower ends of these lower tubes (2*b*) being rigidly fixed to said underframe (1), and the invention being characterised in that; c) the upper ends of the upper tubes (2*a*) are connected to the seating frame (3) in the rotational axis (D); d) a detent plate (14) is arranged on each of the longitudinal tubes (9) and connected to the upper tubes (2*a*), for the purpose of adjusting the incline of the seating frame (3); and e) the rotational axis (D) is provided above said scaling frame (3).

20 Claims, 19 Drawing Sheets

(56) References Cited

U.S. PATENT DOCUMENTS

| | | | | |
|---|---|---|---|---|
| 4,893,827 | A * | 1/1990 | Gay et al. | 280/250.1 |
| 5,884,928 | A | 3/1999 | Papac | |
| 6,447,064 | B1 * | 9/2002 | Mundy et al. | 297/313 |
| 7,281,724 | B1 * | 10/2007 | Larson | 280/250.1 |
| 7,789,402 | B2 * | 9/2010 | Saville et al. | 280/47.38 |
| 8,061,755 | B2 | 11/2011 | Brendel et al. | |
| 8,132,823 | B2 * | 3/2012 | Balcom et al. | 280/250.1 |
| 2009/0045599 | A1 | 2/2009 | Balcom et al. | |
| 2012/0267874 | A1 | 10/2012 | Schrickel et al. | |

FOREIGN PATENT DOCUMENTS

| | | | |
|---|---|---|---|
| DE | 102009049536 | A1 | 4/2011 |
| WO | 2006045316 | A1 | 5/2006 |

* cited by examiner

WHEELCHAIR COMPRISING A HEIGHT-ADJUSTABLE AND INCLINE-ADJUSTABLE SEAT

TECHNICAL FIELD

The invention relates to a wheelchair having an underframe on which front steering wheels and rear drive wheels are fastened at a spacing to one another, a seat frame which is fastened on the underframe so as to be height-adjustable, is mounted so as to be pivotable about a pivot axis and is adjustable in its inclination with regard to the horizontal and in its height, and a backrest frame which is connected to the seat frame which consists of two oppositely situated longitudinal tubes and at least one transverse tube which connects the longitudinal tubes together, wherein the seat frame is connected to the underframe by means of at least two telescopic tubes which are formed from a bottom and a top tube each, and the bottom ends of the bottom tubes are fastened in a rigid manner to the underframe.

BACKGROUND

Such a wheelchair is known, for example, from U.S. Pat. No. 5,884,928 A.

DE 10 2009 049 536 A1 makes known a wheelchair where the seat is adjustable in height and inclination. The seat frame serves for receiving the seat shells or orthopedic seats (which are to be understood as synonymous in the following text) and together with said seat shells forms the seat system for persons who are unable to sit independently as a result of a disability. Seat shells and orthopedic seats are produced individually for said persons because, as a rule, they have serious physical limitations. The seat system is to compensate possibly for existing deformations of the skeleton (for example aligning the pelvis horizontally). As in the case of all sitting persons, the body weight is absorbed to a great extent in the ischium region. In the case of persons with movement limitations, the continual pressure load can result in decubitus. To reduce the risk of decubitus, the body weight has to be distributed over a larger support surface. This is achieved as a result of the inclination of the seat system, the inclination of the seat system being adjusted as a result of an inclination of the seat frame.

In particular when the adjustable region of the inclination is large, for example up to 50°, and the weight of the person utilizing the seat system is heavy, it is necessary for the actuating forces in the case of a change in inclination to be low in order to make the optimum adjustment easier for a carer. The simplest way to reduce the actuating forces is to displace the rotational axis into the common center of gravity of the seat system and the user (patient).

In the case of the wheelchair known from US 2009/0045599 A1, the rotational axis of the seat system is provided in the vicinity of the center of gravity of the user in order to realize angles of inclination of the seat system of up to 50°. Said wheelchair is structurally very expensive. The adjustability of the seat system or of the seat frame can certainly be made easier by means of a telescopic cylinder, the mechanism connected thereto makes the wheelchair more expensive, increases its weight, as a result of which the handling characteristics are impaired, and it is additionally susceptible to faults.

DE 89 08 374 makes known an interchangeable device for a seat which can be connected to an underframe. Said underframe can be a baby-stroller or a wheelchair for children. To this end, the seat is mountable so as to be rotated by 180° such that the line of vision of the person received by the seat is either directed forward or rearward. The seat is fastened on the underframe by means of an adjustable safety lock.

U.S. Pat. No. 2,986,200 discloses a wheelchair where the seat is able to be pivoted from a vertical into a horizontal position in order to be able to transport disabled persons not only sitting but also lying. The seat can assume the function of a bed in the horizontal position.

DE 10 2004 045 388 B4 makes known an electric wheelchair where the seat is adjustable automatically in its inclination such that the seat always remains in the horizontal even when going up and down. Two guide rails, which are mounted in each case in four rollers which are fixed to the chassis, are fastened to the driver's seat for this purpose. If the vehicle travels uphill, the seat is pivoted about a virtual pivot point which is situated in the vicinity of the mass pivot point of a person sitting on the seat.

SUMMARY

Proceeding from said problem definition, the wheelchair described in the introduction is to be improved such that it is not only constructed in a simple manner and comprises a low weight, but also makes it easy to adjust the inclination of the seat system.

For solving the problem, a generic wheelchair is distinguished in that the top ends of the top tubes are connected to the seat frame in the rotational axis and a latching plate which is connected to the top tubes is fastened on each of the longitudinal tubes for adjusting the inclination of the seat frame, and that the rotational axis is provided above the seat frame.

As a result of the two telescopic tubes, the height of the seat frame is easily adjustable—and in particular is also easily manually adjustable. As a result of the top tubes being connected to the seat frame in the rotational axis, the pivot point of the seat frame lies above its center of gravity, as a result of which it becomes possible to place the pivot axis of the seat system into the vicinity of the overall center of gravity, which is formed from the center of gravity of the seat system and from the center of gravity of the user. The inclination can be adjusted as a result of the latching plate which preferably comprises a latching means which extends in an arcuate manner with a radius which corresponds to the effective spacing between the latching bolt and the rotational axis. In order to be able to adjust the inclination in steps, the latching plates comprise a latching means. The spacing between the latching bores themselves determines the steps of the adjustability.

An upwardly projecting seat bracket is preferably mounted on each longitudinal tube so as to be displaceable in the longitudinal direction, the top end of which seat bracket is connected to the top tube in the rotational axis.

In order to facilitate the adjustability of the seat bracket and consequently the displaceability of the center of gravity in the horizontal position, the seat brackets are preferably mounted on the longitudinal tubes so as to be steplessly displaceable. The seat brackets are preferably clampable in a positive locking manner with the longitudnal tubes for fixing.

In order to be able to adapt the stability of the wheelchair to the change in the position of the overall center of gravity, the spacing between the steering wheels and the drive wheels (wheel base) is in particular steplessly adjustable.

In a preferred manner, the telescopic tubes can be telescoped in steps.

In order to be able to adapt the seat frame to the width of the seat shell or of the seat, the at least one transverse tube is realized so it can be telescoped.

The seat shell (or the seat) which, together with the seat frame and the backrest frame, forms a seat system, is insertable into the seat frame. The overall center of gravity, which is composed of the center of gravity of the seat system and the center of gravity of a person sitting in the seat system, lies at least in the direct vicinity of, preferably on the rotational axis.

BRIEF DESCRIPTION OF THE DRAWINGS

An exemplary embodiment of the invention is to be described in more detail by means of a drawing, in which.

DETAILED DESCRIPTION

Figure 1:
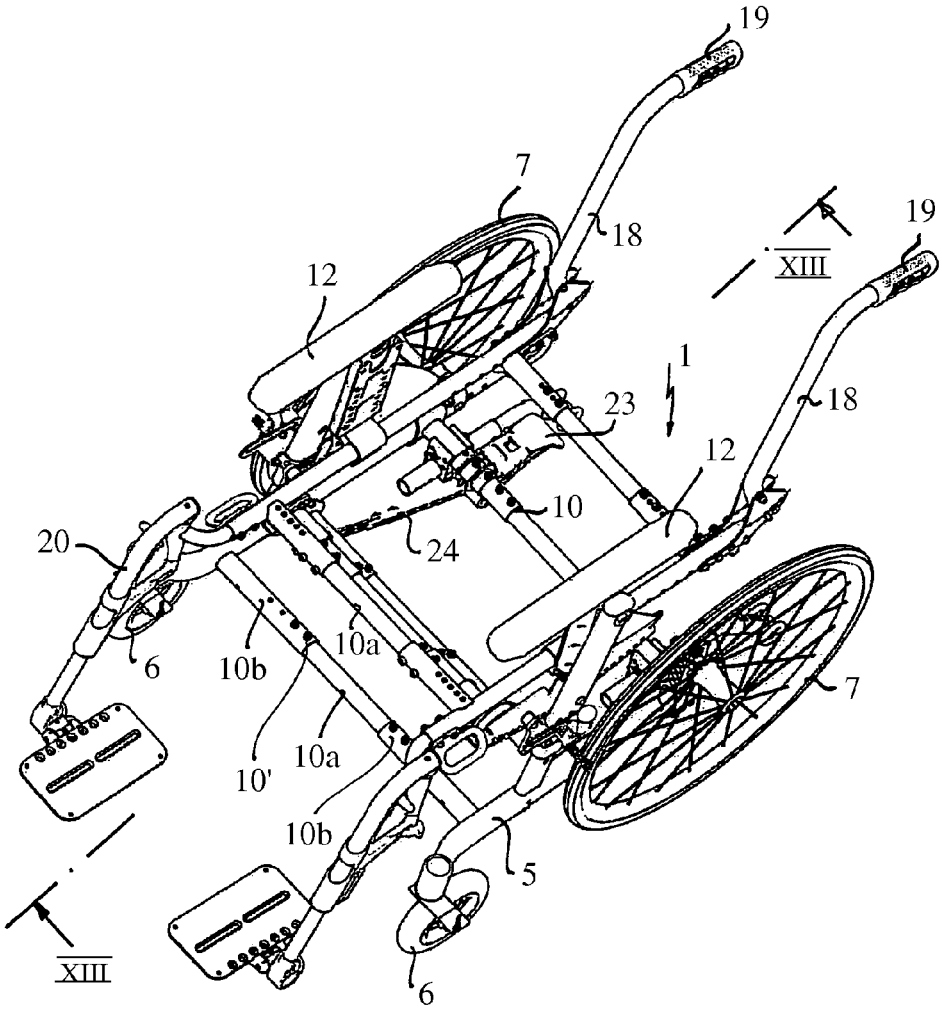
FIG. 1 shows the perspective representation of the wheelchair without a seat system.
Figure 2:
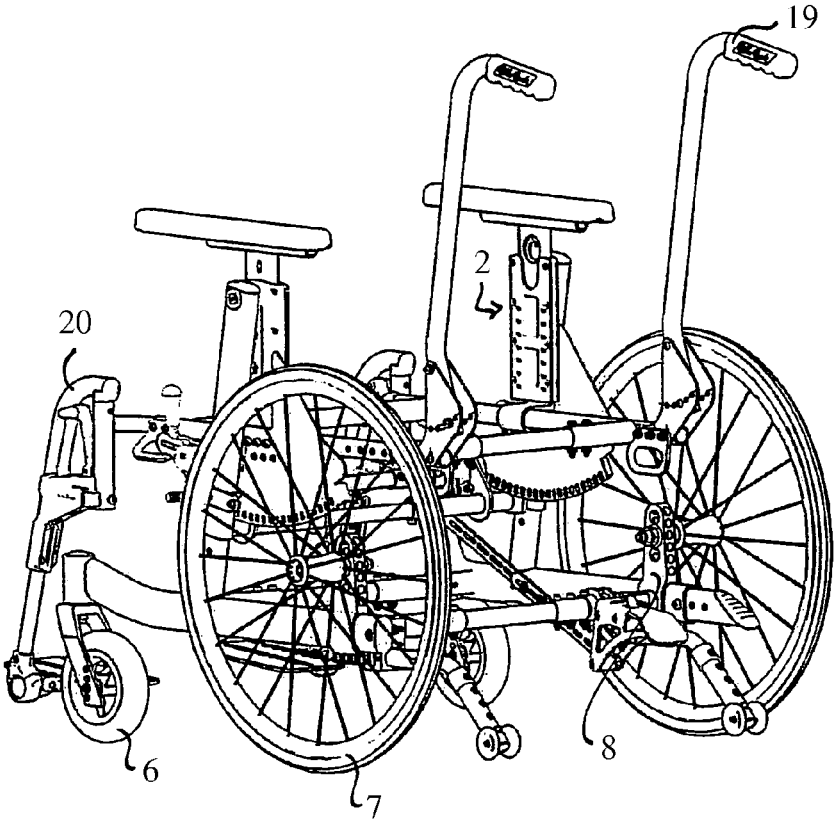
FIG. 2 shows another perspective representation of the wheelchair according to FIG. 1.
Figure 3:
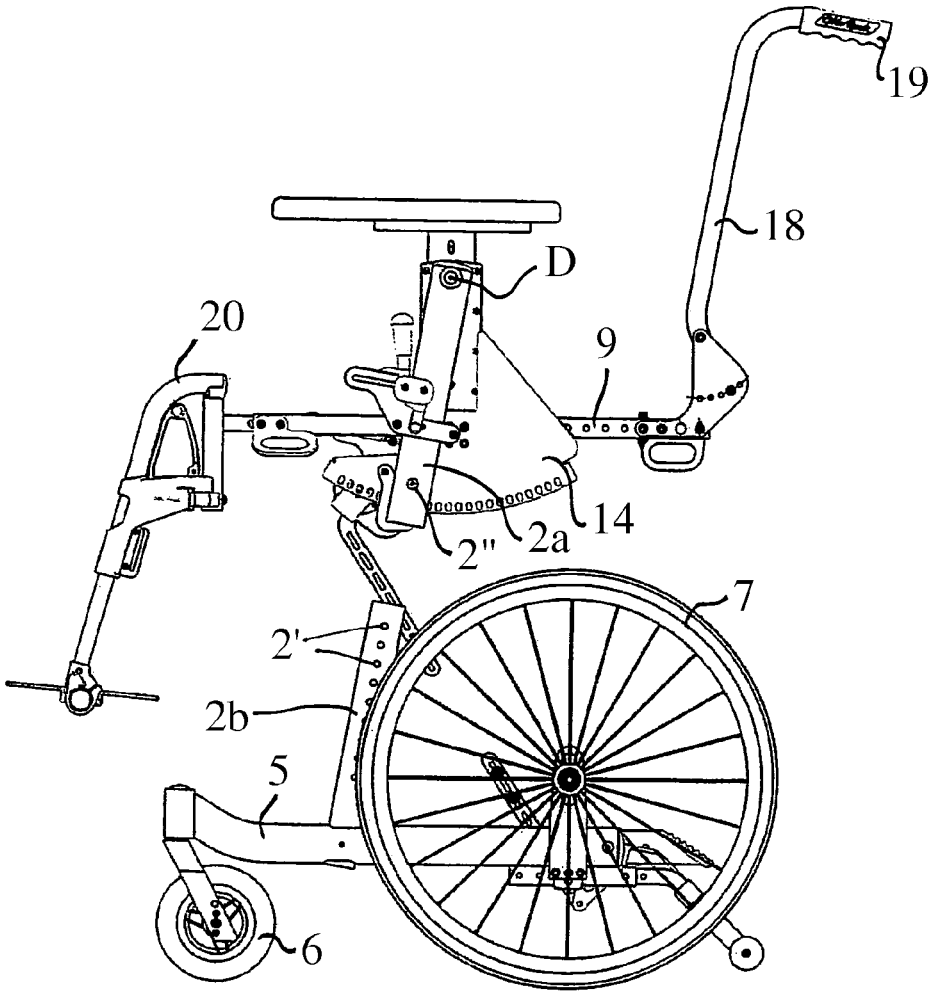
FIG. 3 shows a part representation of the wheelchair according to FIG. 1.
Figure 4:
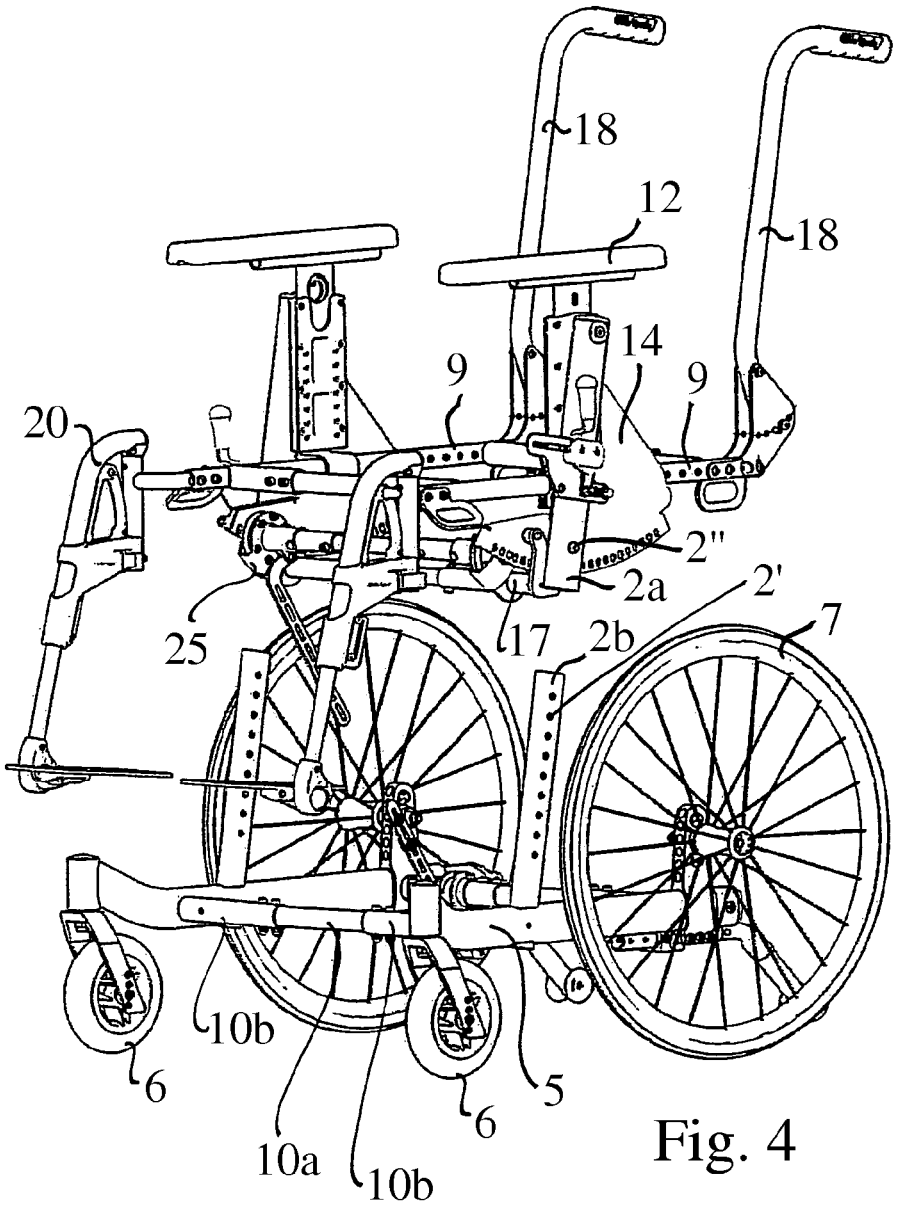
FIG. 4 shows a perspective exploded drawing of the wheelchair.
Figure 5:
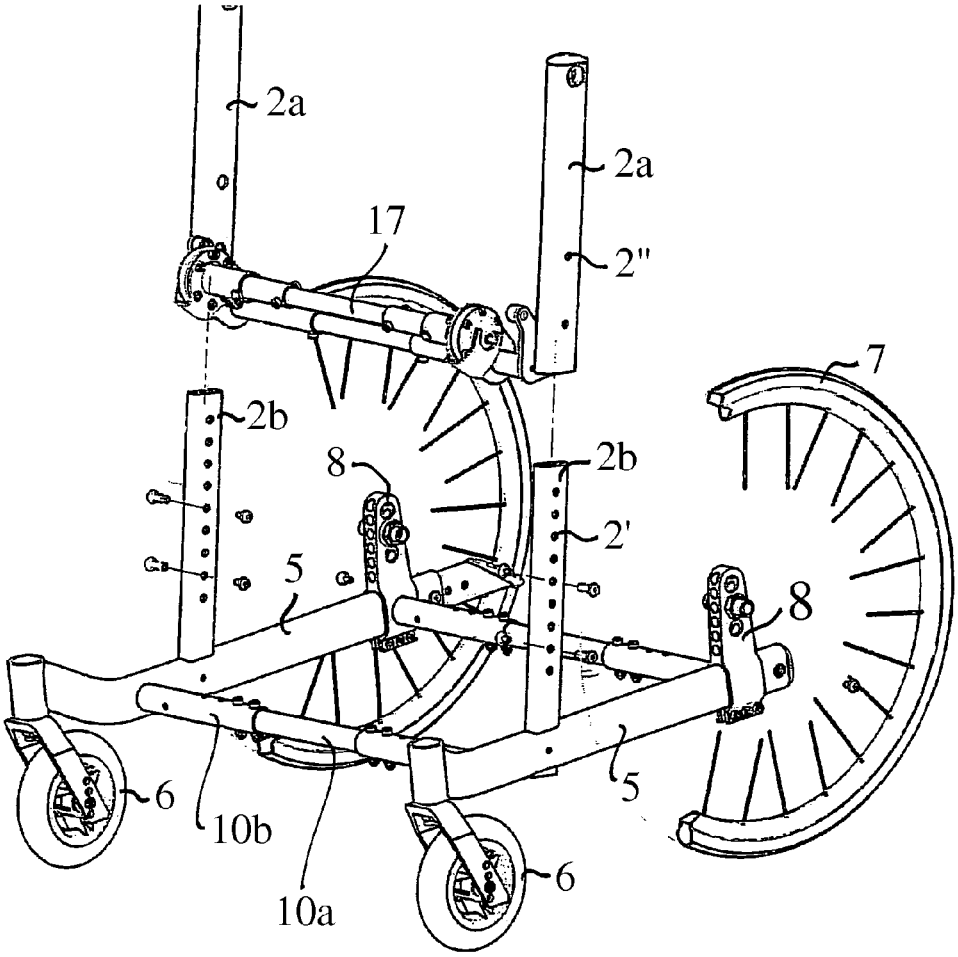
FIG. 5 shows a part representation of the wheelchair according to FIG. 4.
Figure 6:
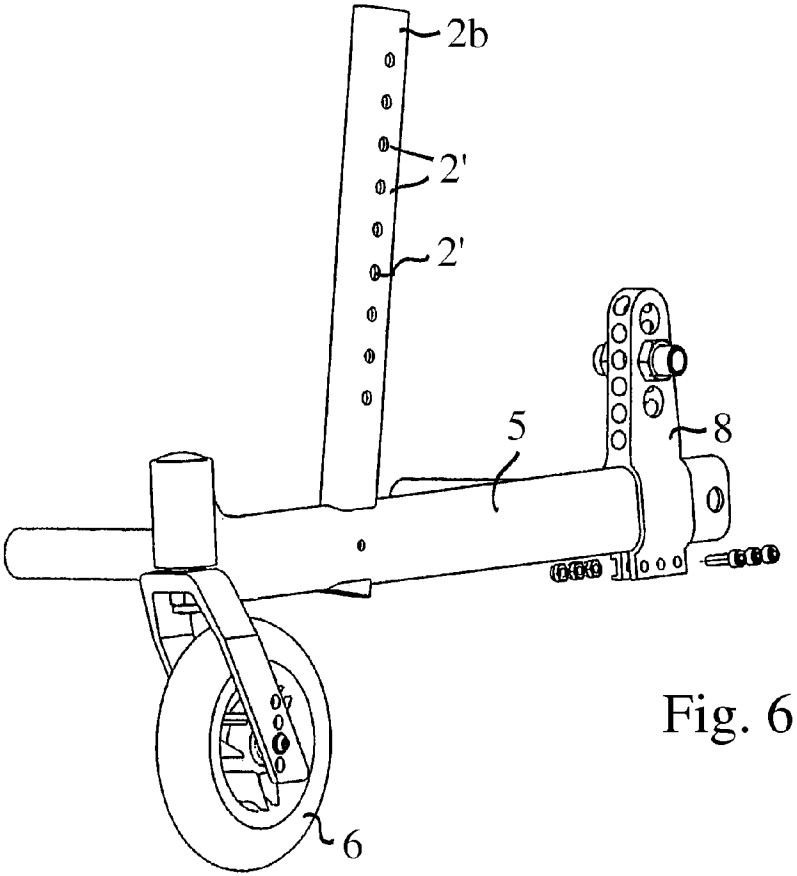
FIG. 6 shows a detail from FIG. 5.

The wheelchair consists of the underframe 1 and the seat frame 3, which is connected by means of the telescopic tubes 2 and into which the seat shell 4 is inserted. The two front steering wheels 6 and the two rear drive wheels 7 are fastened on tubes 5 of the underframe 1 which extend in the longitudinal direction L. The drive wheels 7 are fastened on the tubes 5 by means of clamping lugs 8 and the spacing in the longitudinal direction L between a steering wheel 6 and a drive wheel 7, that is the wheel base, is steplessly adjustable by the clamping lug 8 being released and displaced in the desired direction on the tube 5 and retightened again (cf. FIG. 6).

Figure 11:
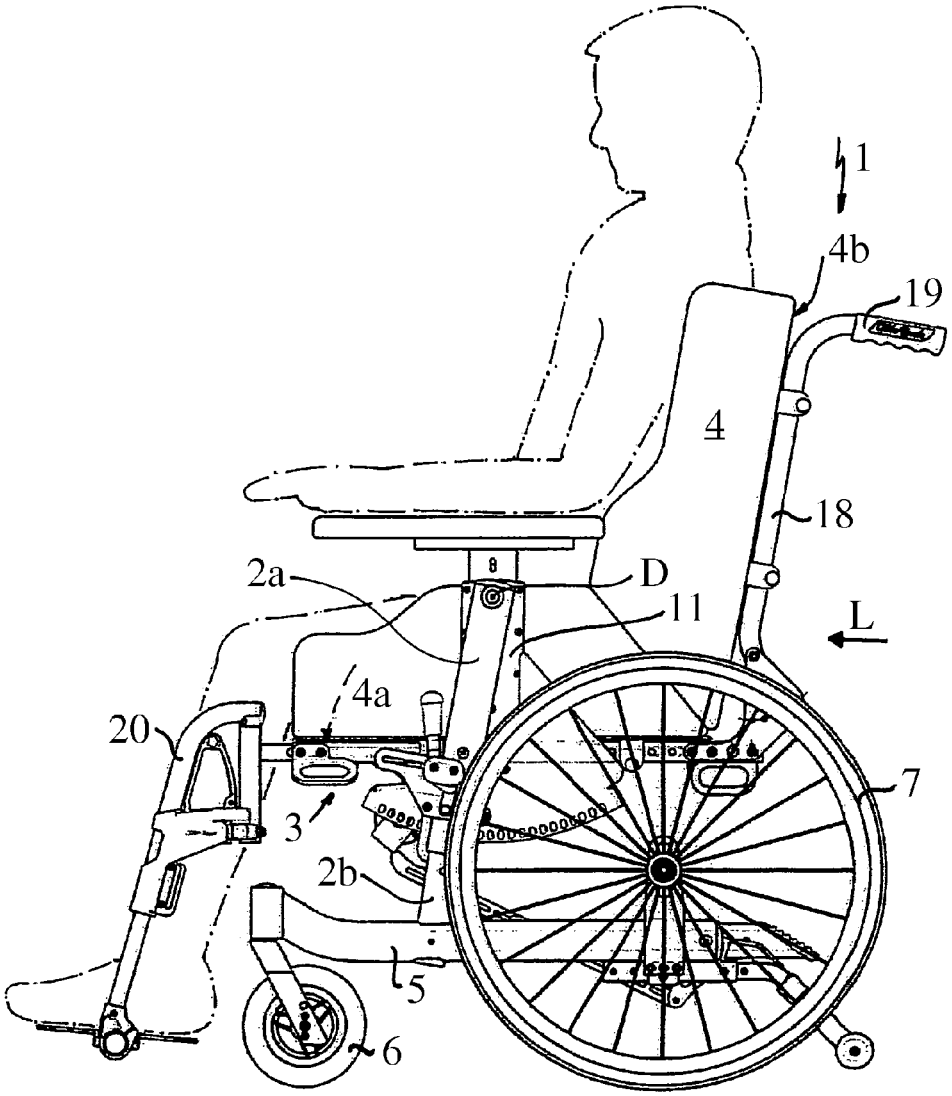
FIG. 11 shows the wheelchair with the seat system and user.
Figure 18:
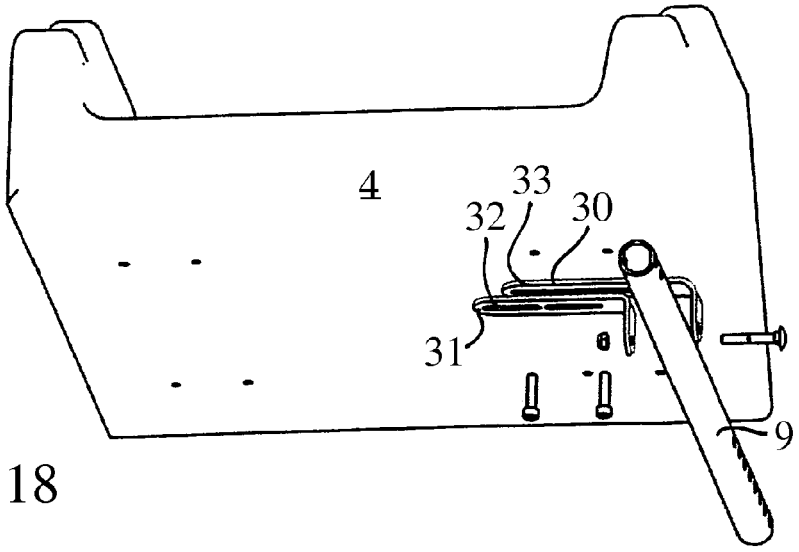
FIG. 18 shows the representation of the seat fastening.

The seat frame 3 consists of the two oppositely situated longitudinal tubes 9 and the two transverse tubes 10 which extend at right angles transversely with respect to said longitudinal tubes and connect the longitudinal tubes 9 together. The transverse tubes 10 consist of the outer tubes 10*b*, which are welded to the longitudinal tubes 9 and into which an inner tube 10*a* can be inserted and screw connected. Bottom transverse tubes 10 connect the bottom longitudinal tubes 5 of the underframe 1 in the same manner. Two seat lugs 11 are fastened on the longitudinal tubes 9 so as to be steplessly adjustable. The seat lugs 11 extend vertically upward and receive the arm rests 12 at their top end. The top tube 2*a* of the telescopic tubes 2 is fastened on the top end of the seat lug 11 above the seat frame 3 so as to be pivotable in the rotational axis D. The bottom tube 2*b* of the telescopic tubes 2 is connected rigidly to the longitudinal tubes 5 of the underframe 1. The seat 4 is fastened on the seat tubes 9 by means of lugs 30, 31 (cf. FIG. 18). The lugs 30, 31 are screw-connected to the under surface of the seat 4. Their ends facing the longitudinal tubes 9 are bent downward at right angles. The ends fastened to the seat comprise elongated holes 32, 33 such that the lugs 30, 31 are able to be adapted in their relative position in a stepless manner to the longitudinal tubes 9. Seats 4 which are individually adapted to the user can consequently be adapted simply to the seat frame 3 and fastened to the same. In the usual manner, the seat 4 consists of the seat surface 4*a*, on which the user sits, and the seat back 4*b* which supports his back. For lateral support, side wings can be provided on the seat surface 4*a* and the seat back 4*b* (cf. FIG. 11). The rotational axis D is consequently situated above the seat surface 4*a*.

A latching plate 14, which comprises a latching means 15 which extends in an arcuate manner, is provided on each of the longitudinal tubes 9 of the seat frame 3. The latching plates 14 are steplessly displaceable in the longitudinal direction L together with the seat lugs 11 on the longitudinal tubes 9 and are clampable thereon in a positive locking manner. The radius R of the circular arc of the bores 15*a*, which are spaced apart from one another and form the latching means 15, corresponds to the effective spacing between the rotational axis D and the latching bolt 21 which is fastened on the top tube 2*a* and interacts with the latching means 15. The back rest frame, which is formed from the two tubes 18, on the top end of which push handles 19 are provided, is provided at the rear end of the seat frame 3. The foot supports 20 are fastened at the front on the longitudinal tubes 9.

The bottom tubes 2*b* of the telescopic tubes 2 are provided laterally with a plurality of bores 2' which are spaced apart from one another in parallel. The top tubes 2*a* comprise lateral bores 2". The length of the telescopic tubes 2 and consequently the height of the seat frame 2 can be adjusted by means of the bores 2', 2" by means of a releasable screw connection.

Figure 7:
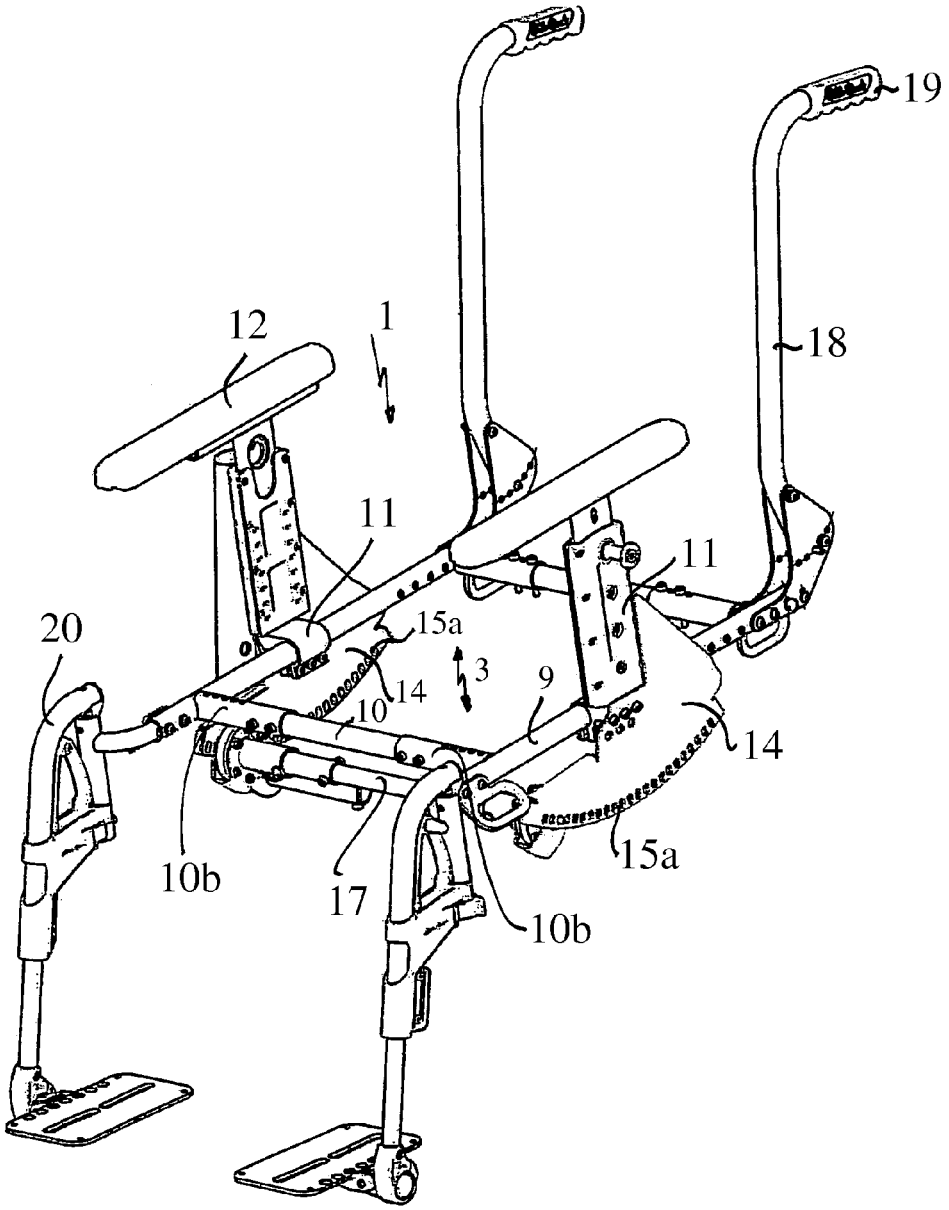
FIG. 7 shows a further part representation of the wheelchair.
Figure 7A:
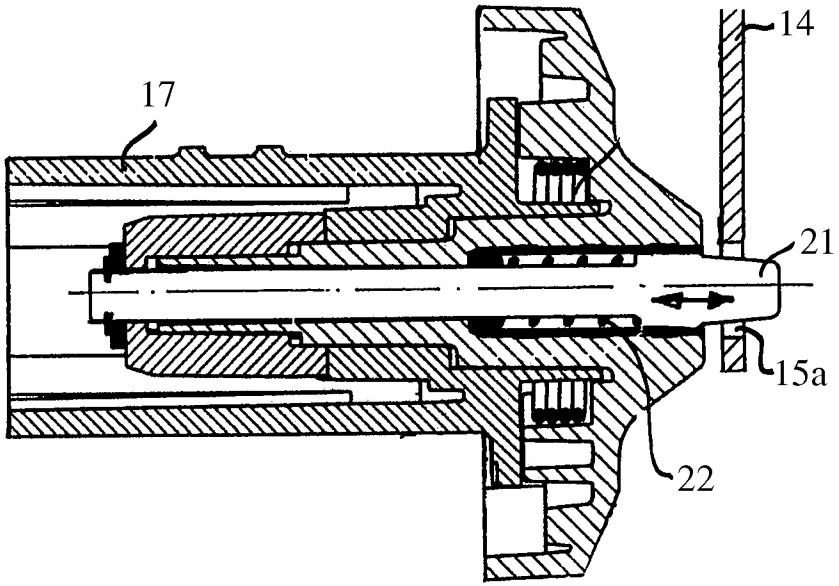
FIG. 7*a* shows a detail to illustrate the locking means according to FIG. 7.
Figure 8:
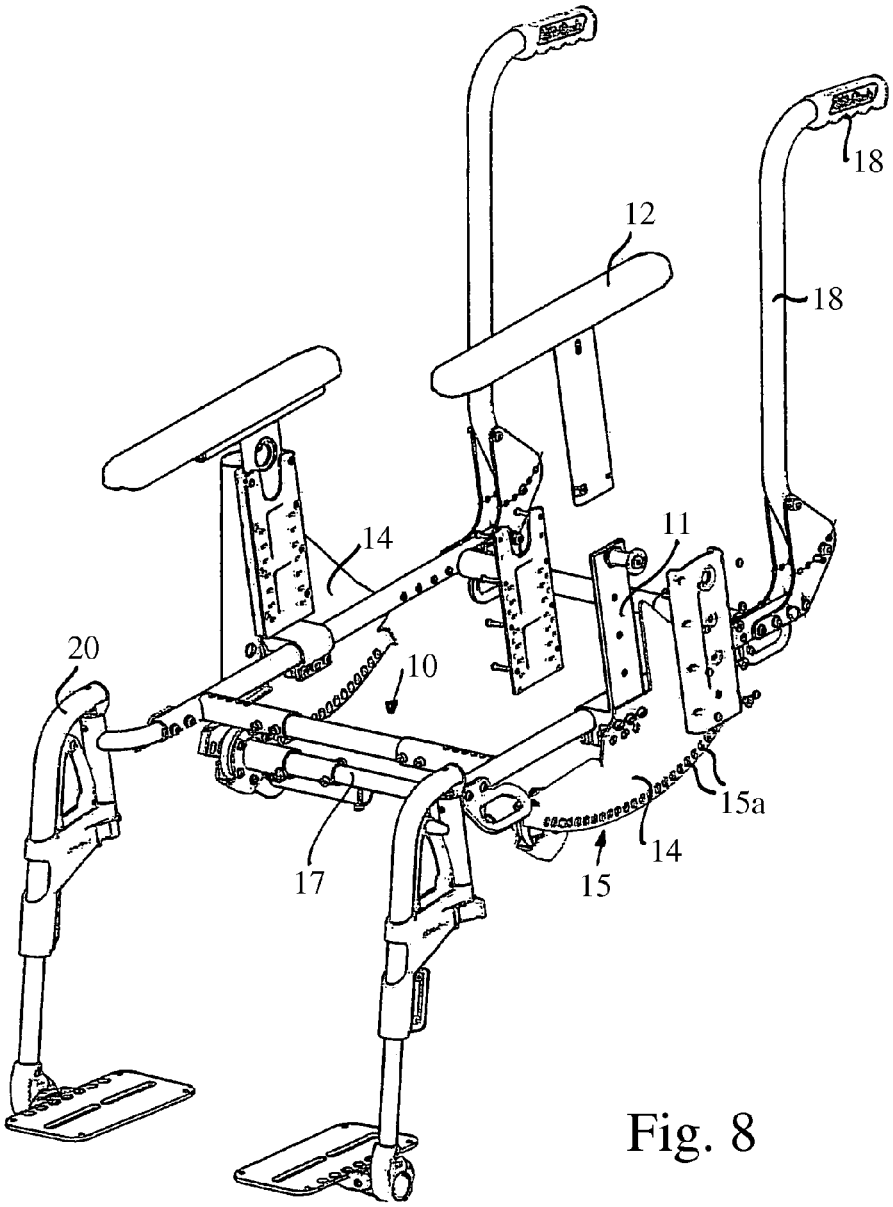
FIG. 8 shows a part exploded drawing of the wheelchair.
Figure 9:
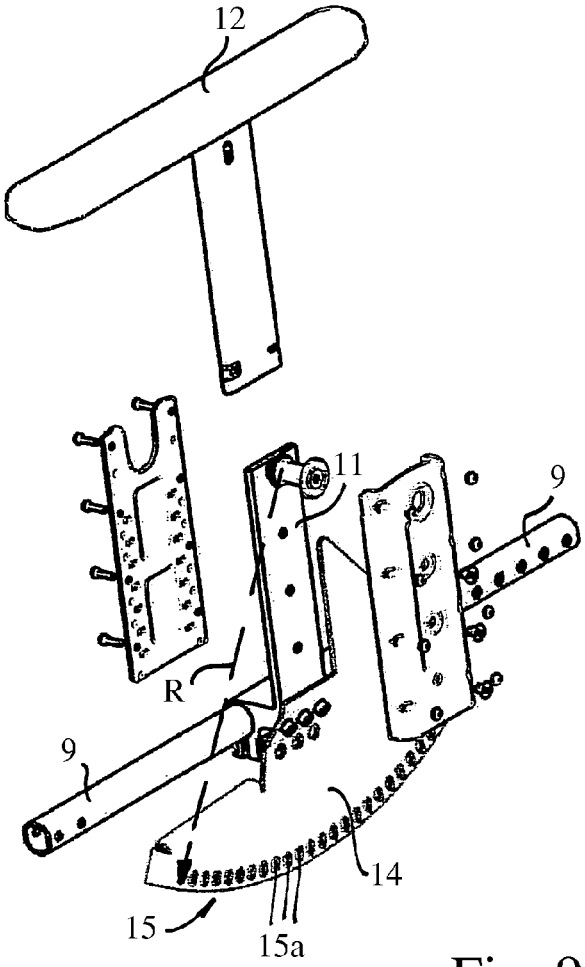
FIG. 9 shows a detail from FIG. 8.
Figure 10:
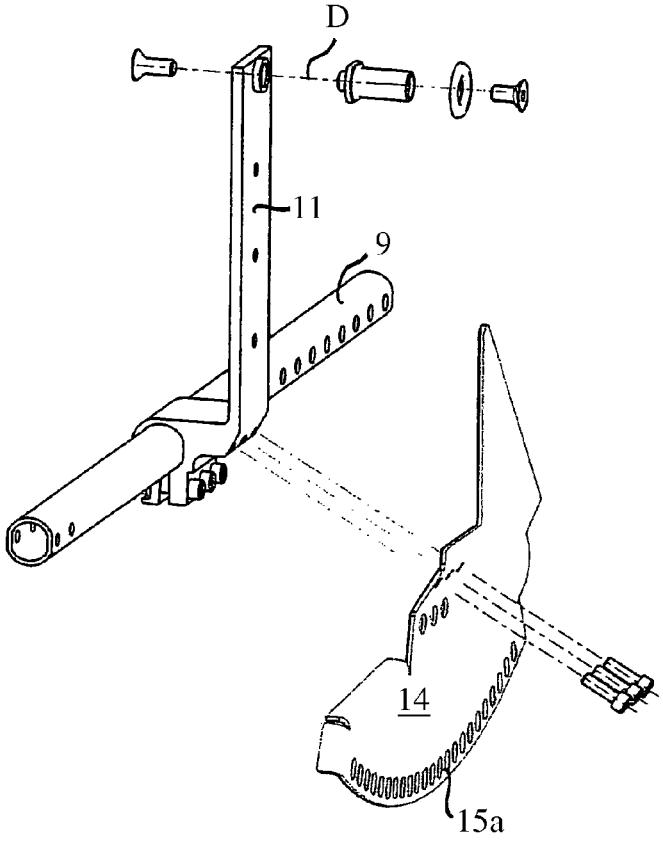
FIG. 10 shows an exploded drawing of a detail.
Figure 12:
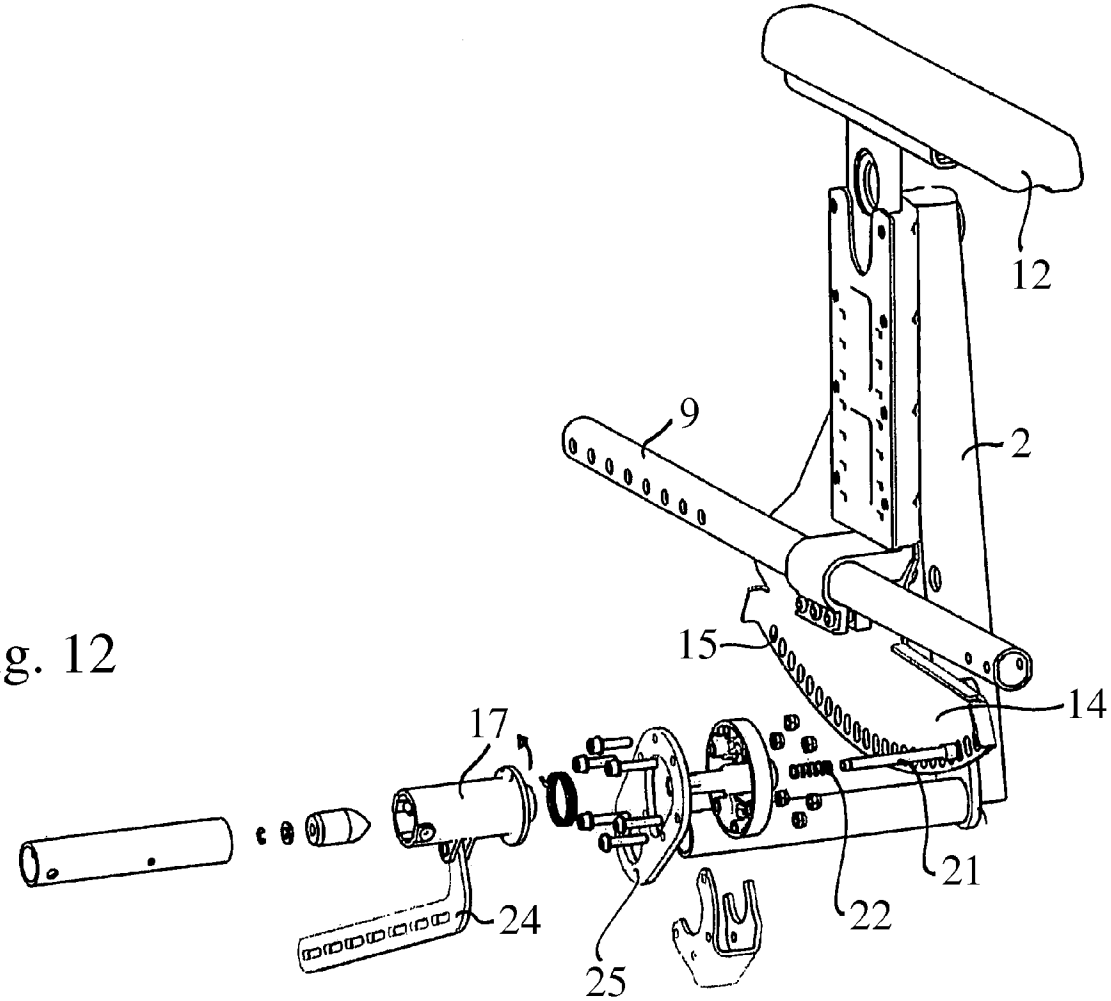
FIG. 12 shows an exploded drawing of a detail of the wheelchair.
Figure 13:
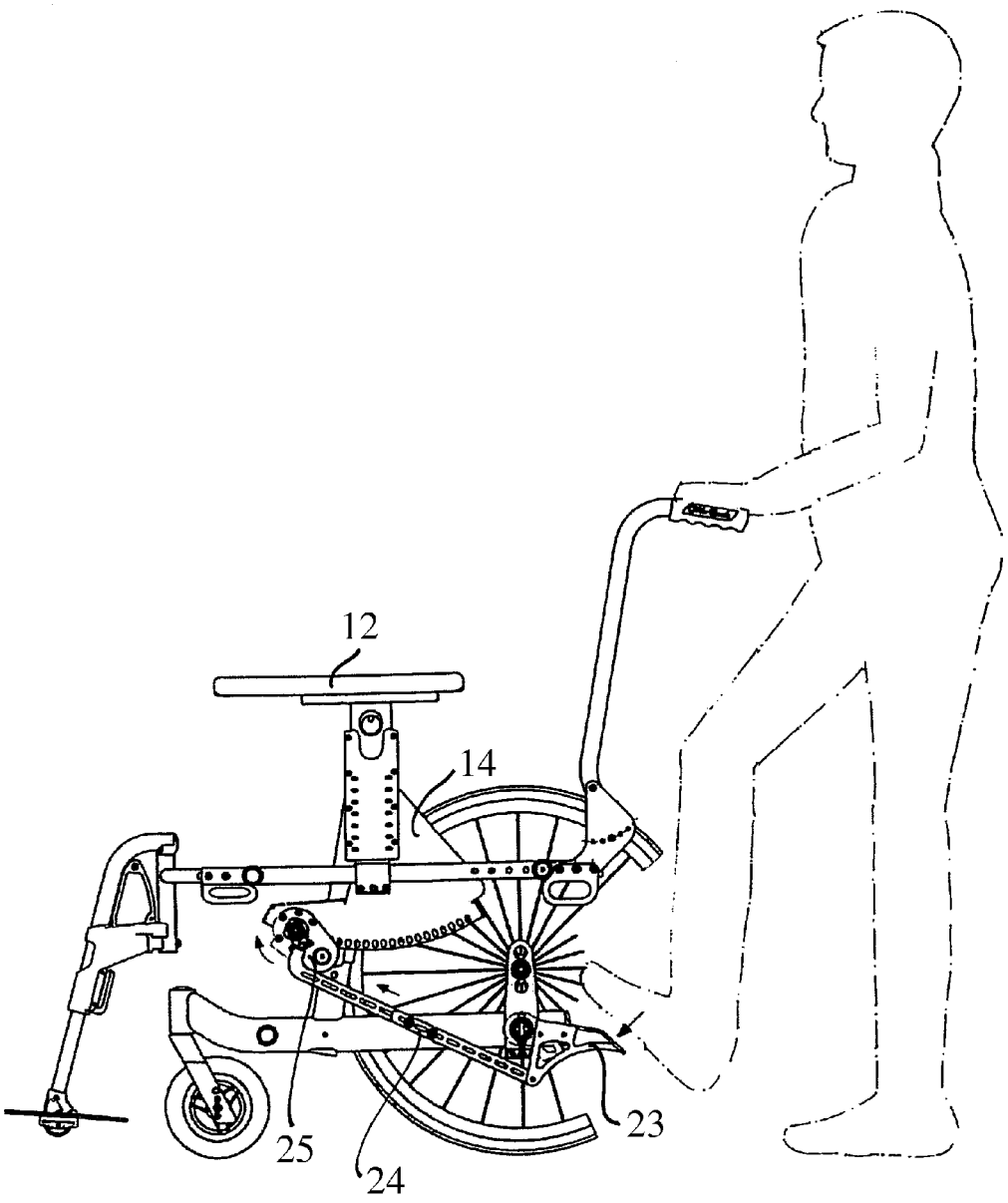
FIG. 13 shows the section along the line XIII-XIII according to FIG. 1 to illustrate the adjustment mechanism for the seat inclination.
Figure 14:
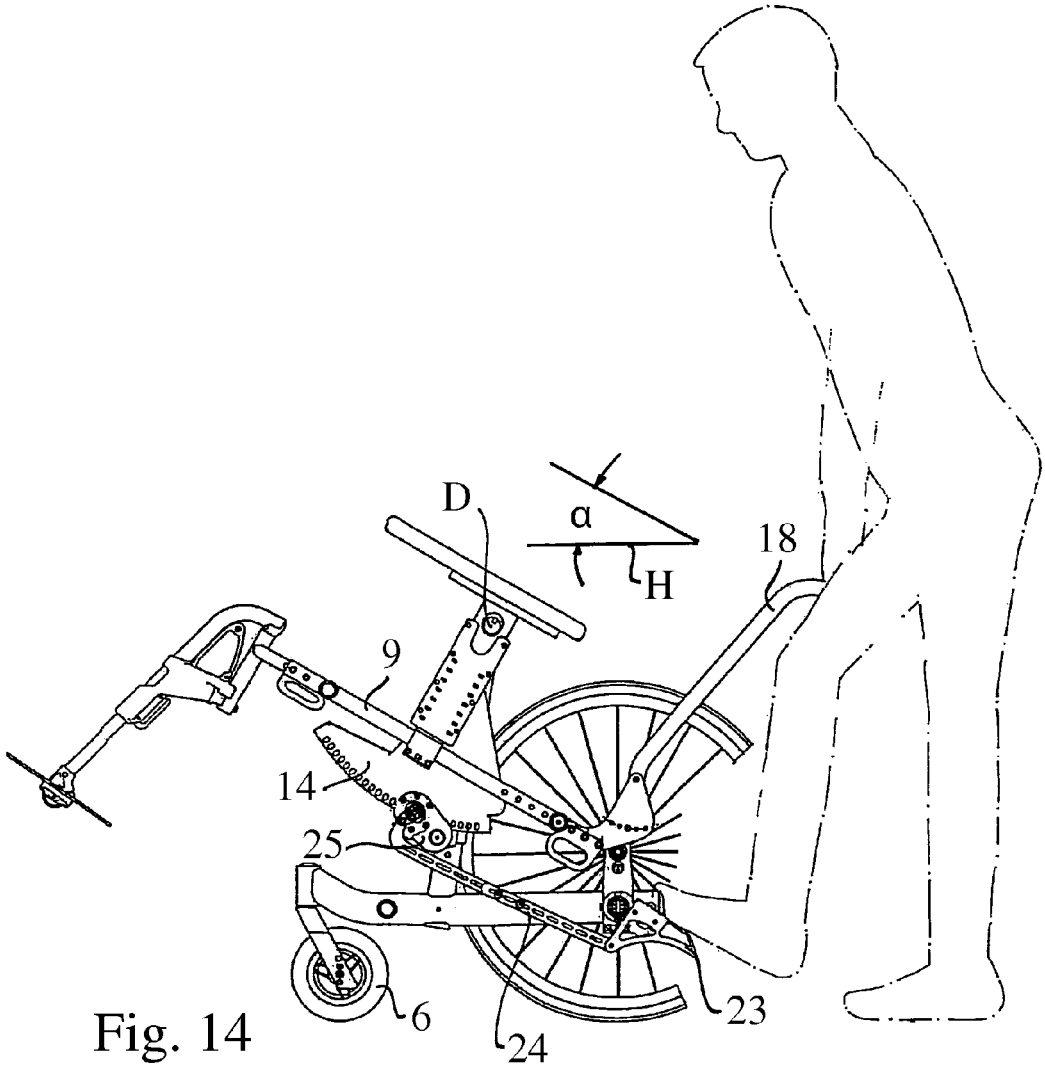
FIG. 14 shows the representation according to FIG. 13 in the inclined position (unlocked adjustment mechanism)
Figure 15:
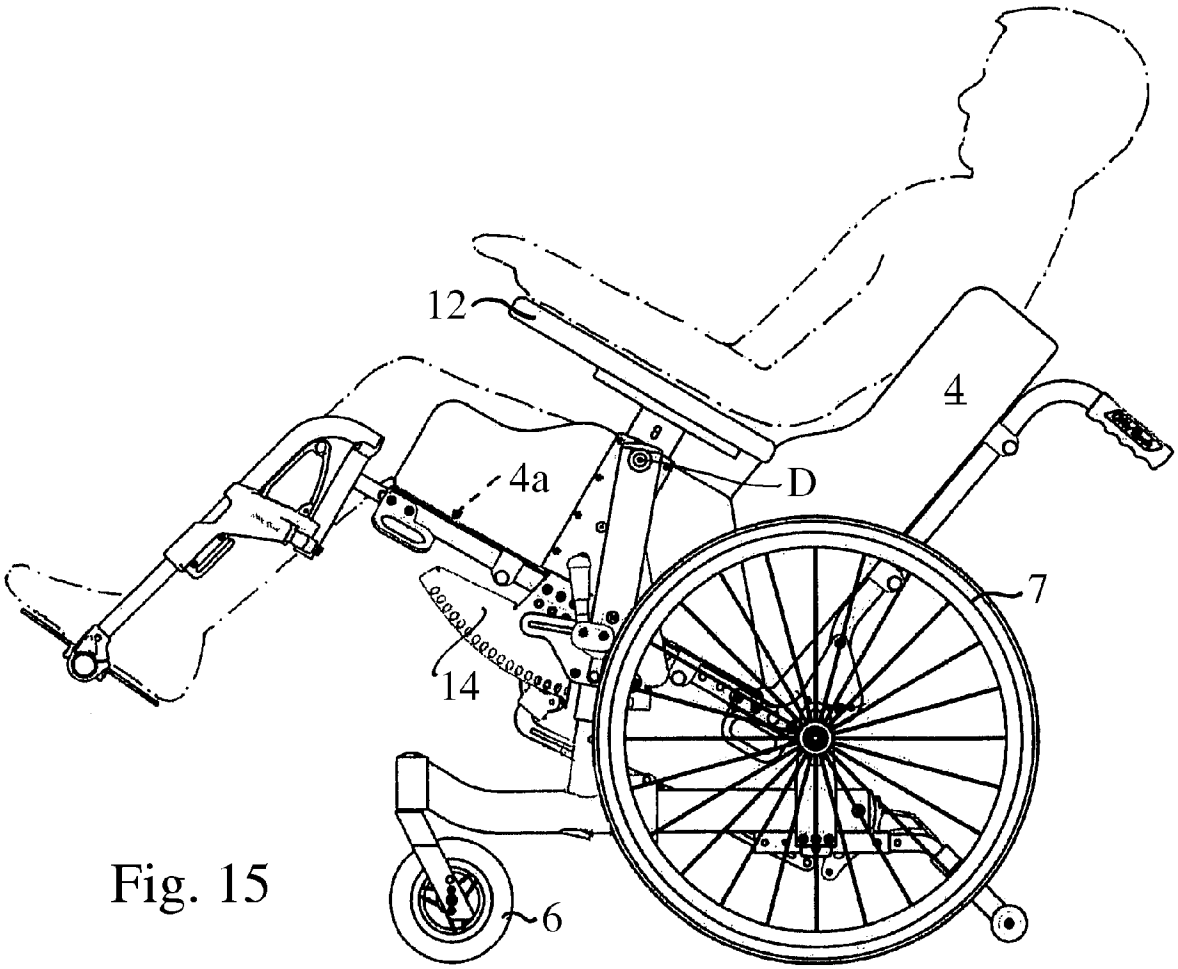
FIG. 15 shows a side view of the wheelchair.
Figure 16:
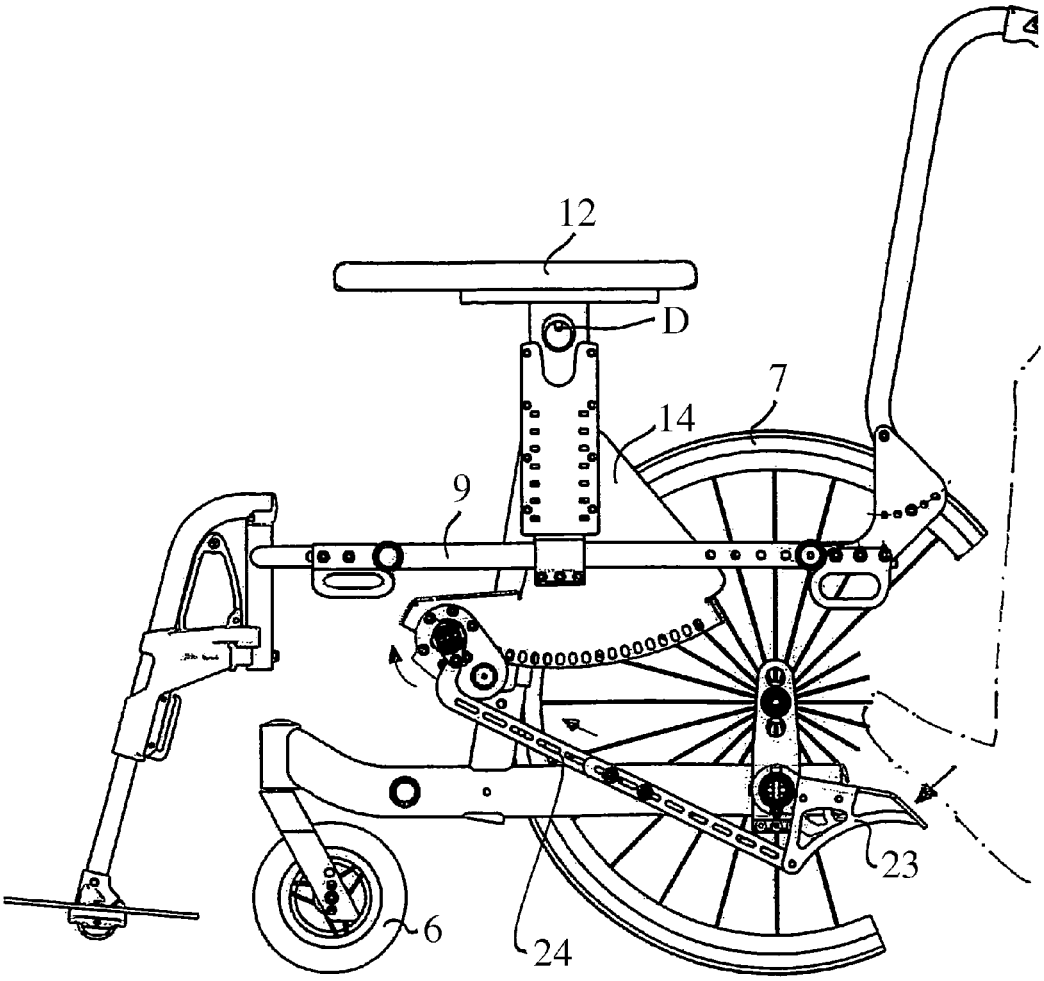
FIG. 16 shows an enlarged representation from FIG. 13 (locked adjustment mechanism)
Figure 17:
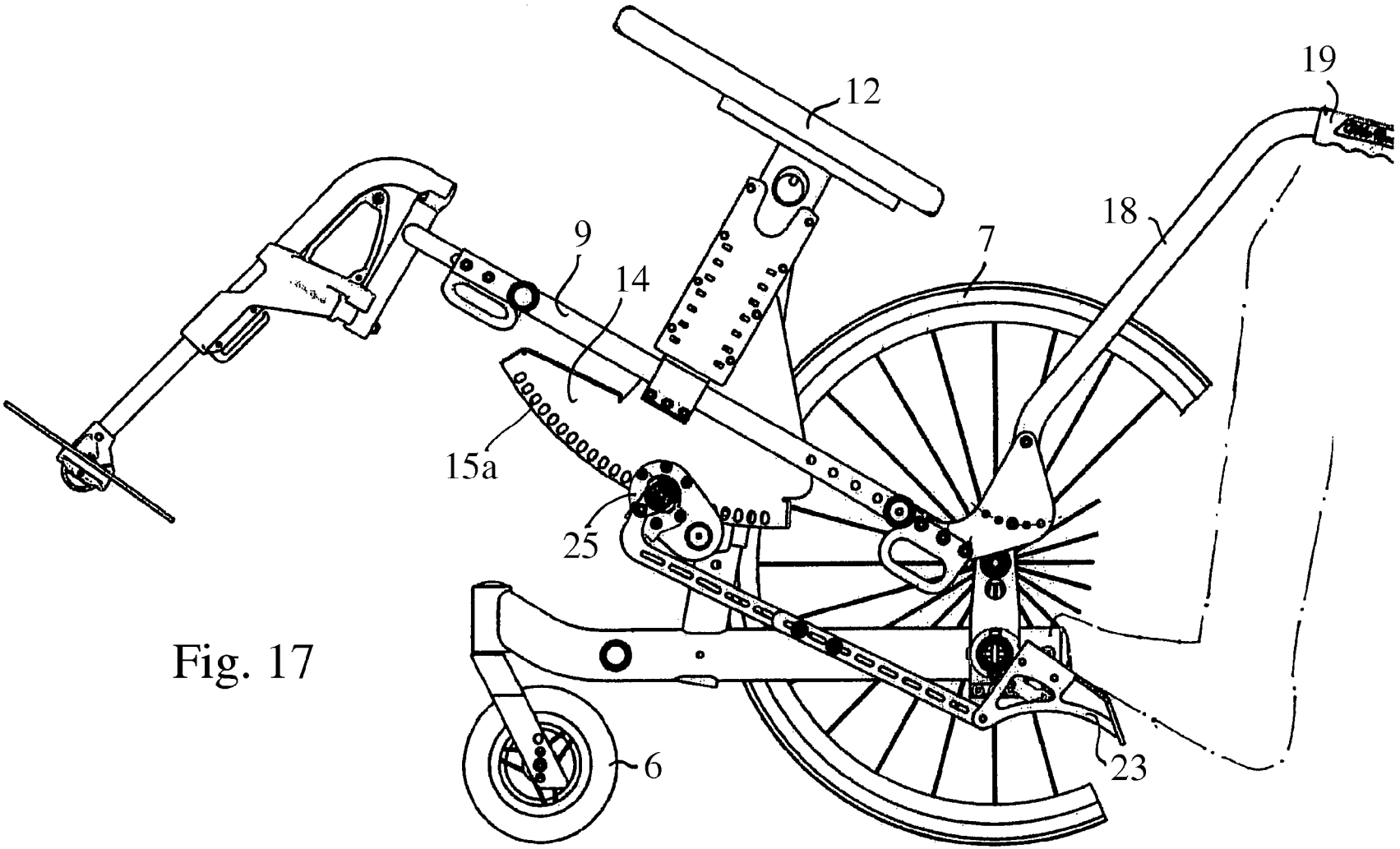
FIG. 17 shows an enlarged representation from FIG. 14.

The adjusting of the angle of inclination $\alpha$ of the seat frame 3 is effected as follows:

A tube 17, which comprises a spring-loaded latching bolt 21 in the region of each of its two outer ends (cf. FIGS. 7, 7*a*), is arranged below the front transverse rod 10. The latching bolts 21 are displaceable against the force of the spring 22 in the direction of the arrow. To adjust the inclination of the seat there is provided a release pedal 23, which is actuatable by the operating person and is connected to the flange 25 by means of a lifting mechanism 24, by means of which flange the movement is transferred to the locking device which is shown in detail in FIG. 12. When the release pedal 23 is stepped on, the locking bolt 21 is displaced against the force of the spring 22 and is moved out of the bore 15*a* of the latching plate 14. It is then possible to adjust the inclination of the seat 4. When the actuating pedal 23 is released, the latching bolt 21 springs back into its original position and, once it moves into coincidence with the desired bore 15*a*, latches into place again, and the seat 4 is fixed in its inclination at the desired angle $\alpha$.

The transverse tubes 10 of the seat frame 3 can be telescoped for adjusting the width. The outer tubes 10*b* are screw-connected to the inner tube 10*a*. The backrest frame is formed by the two tubes 18 which are connected to the longitudinal tubes 9 of the seat frame 3.

List Of References
1 Underframe
2 Telescopic tube
2*a* Top tube
2*b* Bottom tube
2' Bore
2" Bore
3 Seat frame
4 Seat shell/seat
4*a* Seat surface
4*b* Seat back
5 Longitudinal tube
6 Steering wheel
7 Drive wheel
8 Clamping lug
9 Longitudinal tube
10*a* Inner tube
10*b* Outer tube
10' Bore
11 Seat bracket
12 Armrest
14 Latching plate
15 Latching means
15*a* Bore
17 Tube
18 Tube
19 Push handle
20 Foot support
21 Latching bolt
22 Compression spring
23 Release pedal
24 Lifting mechanism
25 Flange
30 Lug
31 Lug
32 Elongated hole
33 Elongated hole
D Rotational axis
H Horizontal
L Longitudinal direction
R Radius
α Angle of inclination

The invention claimed is:

1. A wheelchair having an underframe on which front steering wheels and rear drive wheels are fastened at a spacing to one another, a seat frame which is fastened on the underframe so as to be height-adjustable, is mounted so as to be pivotable about a rotational axis, and is adjustable in its inclination with regard to a horizontal plane and in its height, and a backrest frame which is connected to the seat frame and which consists of two oppositely situated longitudinal tubes and at least one transverse tube, which connects the longitudinal tubes together, wherein a) the seat frame is connected to the underframe with at least two telescopic tubes, each telescoping tube being formed by a bottom tube and a top tube, b) bottom ends of the bottom tubes are fastened in a rigid manner to the under frame, c) top ends of the top tubes are connected to the seat frame in the rotational axis, d) a latching plate, which is connected to the top tubes, is arranged on each of the longitudinal tubes for adjusting the inclination of the seat frame, and e) the rotational axis is provided above the seat frame.

2. The wheelchair as claimed in claim 1, wherein an upwardly projecting seat bracket is mounted on each longitudinal tube so as to be displaceable in the longitudinal direction, the top end of which seat bracket is connected to the top tube in the rotational axis.

3. The wheelchair as claimed in claim 2, wherein the seat brackets are mounted on the longitudinal tubes so as to be steplessly displaceable.

4. The wheelchair as claimed in claim 3, wherein the seat brackets are clampable in a positive locking manner on the longitudinal tubes.

5. The wheelchair as claimed in claim 1, wherein the spacing between the steering wheels and the drive wheels is adjustable.

6. The wheelchair as claimed claim 5, wherein the spacing is steplessly adjustable.

7. The wheelchair as claimed in claim 1, wherein the telescopic tubes can be telescoped in steps.

8. The wheelchair as claimed in claim 1, wherein the latching plate comprises a latching member which extends in an arcuate manner with a radius, said radius corresponding to an effective spacing between the rotational axis and a latching bolt.

9. The wheelchair as claimed in claim 1, wherein the at least one transverse tube can be telescoped for adjusting a width of the seat frame.

10. The wheelchair as claimed in claim 1, wherein a seat shell which, together with the seat frame and the backrest frame, forms a seat system, is insertable into the seat frame, and an overall center of gravity, which is composed of a center of gravity of the seat system and a center of gravity of a person sitting in the seat shell, lies at least in a direct vicinity of, the rotational axis.

11. The wheelchair as claimed in claim 1, further comprising a seat shell which, together with the seat frame and the backrest frame, forms a seat system, and is insertable into the seat frame, wherein an overall center of gravity, which is composed of a center of gravity of the seat system and a center of gravity of a person sitting in the seat shell, lies at least in the direct vicinity of the rotational axis.

12. A wheelchair, comprising:

an underframe;

front steering wheels and rear drive wheels fastened to the underframe at spaced apart locations;

a seat frame fastened to the underframe and configured to be height-adjustable, pivotable about a rotational axis, and adjustable in its inclination relative to horizontal and height directions, wherein the rotational axis is provided above the seat frame;

a backrest frame connected to the seat frame and comprising two oppositely situated longitudinal tubes and at least one transverse tube that connects the longitudinal tubes together;

at least two telescopic tubes, each telescoping tube comprising a bottom tube and a top tube, and being configured to connect the seat frame to the underframe, wherein bottom ends of the bottom tubes have a rigid connection to the under frame, and top ends of the top tubes are connected to the seat frame in the rotational axis;

a latching plate connected to the top tubes and arranged on each of the longitudinal tubes for adjusting the inclination of the seat frame.

13. The wheelchair as claimed in claim 12, further comprising an upwardly projecting seat bracket mounted on each longitudinal tube and displaceable in a longitudinal direction, wherein a top end of the seat bracket is connected to the top tube in the rotational axis.

14. The wheelchair as claimed in claim 13, wherein the seat brackets are steplessly displaceable on the longitudinal tubes.

15. The wheelchair as claimed in claim 14, wherein the seat brackets are clampable in a positive locking manner on the longitudinal tubes.

16. The wheelchair as claimed in claim 12, wherein a spacing between the steering wheels and the drive wheels is adjustable.

17. The wheelchair as claimed claim 16, wherein the spacing is steplessly adjustable.

18. The wheelchair as claimed in claim 12, wherein the telescopic tubes are configured to be telescoped in steps.

19. The wheelchair as claimed in claim 12, wherein the latching plate comprises a latching member that extends in an arcuate manner with a radius, the radius corresponding to an effective spacing between the rotational axis and a latching bolt.

20. The wheelchair as claimed in claim 12, wherein the at least one transverse tube is configured to telescope to adjust a width of the seat frame.

* * * * *